US012064677B1

(12) United States Patent
Janszen

(10) Patent No.: US 12,064,677 B1
(45) Date of Patent: Aug. 20, 2024

(54) WEARABLE SLING FOR IMPROVING GOLF SWING

(71) Applicant: Paul Janszen, Cleves, OH (US)

(72) Inventor: Paul Janszen, Cleves, OH (US)

( * ) Notice: Subject to any disclaimer, the term of this patent is extended or adjusted under 35 U.S.C. 154(b) by 0 days.

(21) Appl. No.: 18/196,197

(22) Filed: May 11, 2023

(51) Int. Cl.
*A63B 69/36* (2006.01)

(52) U.S. Cl.
CPC ..... *A63B 69/3608* (2013.01); *A63B 2225/09* (2013.01)

(58) Field of Classification Search
CPC ..... A63B 69/3685; A63B 69/3608; A63B 2225/09
USPC ..... 473/207, 215, 464, 409
See application file for complete search history.

(56) References Cited

U.S. PATENT DOCUMENTS 3,838,852 A * 10/1974 Gury ..... A63B 21/0552 482/125
4,895,373 A 1/1990 Richmon
5,188,365 A * 2/1993 Picard ..... A63B 69/0059 473/215
5,318,494 A * 6/1994 Santighian ..... A63B 21/0004 482/121
5,665,015 A 9/1997 Clark, III
5,704,856 A * 1/1998 Morse ..... A63B 69/0002 473/212
6,832,960 B2 * 12/2004 Thony ..... A63B 69/0059 473/277
7,314,437 B2 * 1/2008 Frappier ..... A63B 21/4025 482/126
9,630,081 B2 * 4/2017 Gillespie ..... A63B 71/0054
10,688,361 B2 * 6/2020 Cottam ..... A63B 69/0059
2011/0111930 A1 * 5/2011 Byrd ..... A63B 69/0059 482/121
2011/0306477 A1 * 12/2011 Keen ..... A63B 23/12 482/122
2012/0264535 A1 10/2012 O'Brien
2014/0135674 A1 * 5/2014 Kirk ..... A61F 5/026 602/20

FOREIGN PATENT DOCUMENTS

WO WO 2021/1230545 11/2021

* cited by examiner

*Primary Examiner* — Nini F Legesse
(74) *Attorney, Agent, or Firm* — Frost Brown Todd LLP

(57) ABSTRACT

A golf swing training apparatus includes an elastic sling configured to transition between an unstretched state and a stretched state. The elastic sling includes an arm loop and a leg loop coupled to the arm loop. The apparatus includes a first aperture defined by the arm loop. The first aperture is sized and configured to receive a trailing arm elbow of a golfer such that a portion of the arm loop is seated at or near a trailing arm cubital fossa of the golfer. The apparatus includes a second aperture defined by the leg loop. The second aperture is sized and configured to receive a leading leg upper thigh of the golfer such that a portion of the leg loop is seated at or near a crotch of the golfer when the portion of the arm loop is seated at or near the trailing arm cubital fossa of the golfer.

20 Claims, 12 Drawing Sheets

WEARABLE SLING FOR IMPROVING GOLF SWING

BACKGROUND

Golf is a sport enjoyed by many individuals. Golfers typically strive for a more powerful and accurate golf swing. Increased power tends to provide a golfer with a greater distance in which to hit the golfer's shots, and improved accuracy will allow the golfer to take better aim toward the target. Combined, improving power and accuracy can allow a golfer to achieve higher scores.

Typically, the best way to achieve consistent improvements in power and accuracy by improving one's swinging technique. Taking lessons is a proven way for a golfer to improve the golfer's swinging technique, and therefore power and accuracy. However, significant improvement from such lessons typically requires a myriad of hours, as well as the cost to pay an instructor. Therefore, golfers may desire golf training aids to aid golfers in refining their swinging technique.

While various types of golf training aids have been made and used, it is believed that no one prior to the inventor(s) has made or used the invention described herein.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
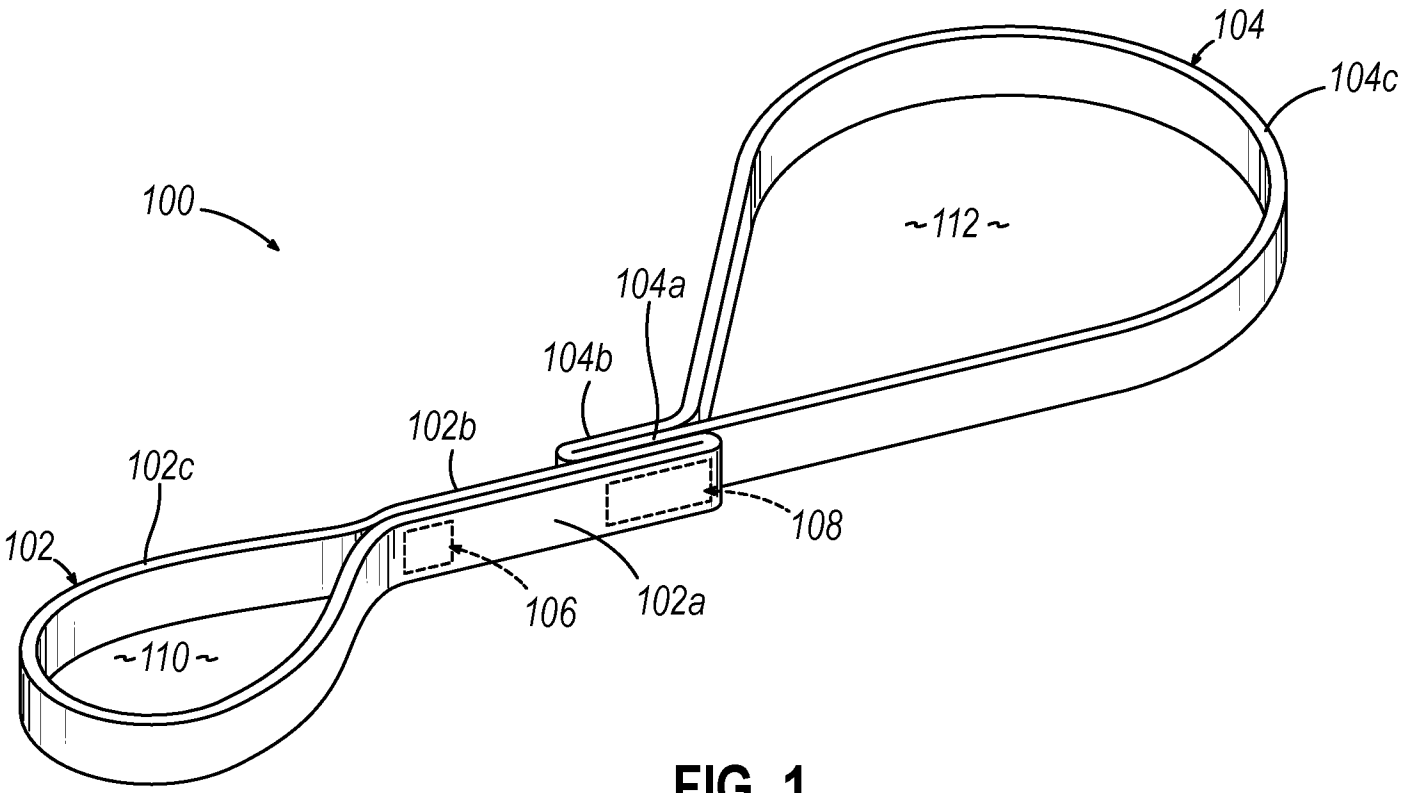
FIG. 1 depicts a top perspective view of an example of a sling for improving a golfer's swinging technique, the sling including two looped segments formed by two elastic bands, the sling being in a relaxed (e.g., unstretched) state.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

The terms "about," "approximately," and the like as used herein in connection with any numerical values or ranges of values are intended to encompass the exact value(s) referenced as well as a suitable tolerance that enables the referenced feature or combination of features to function for the intended purpose described herein.

I. Exemplary Golf Swing Training Apparatus

Figure 2:
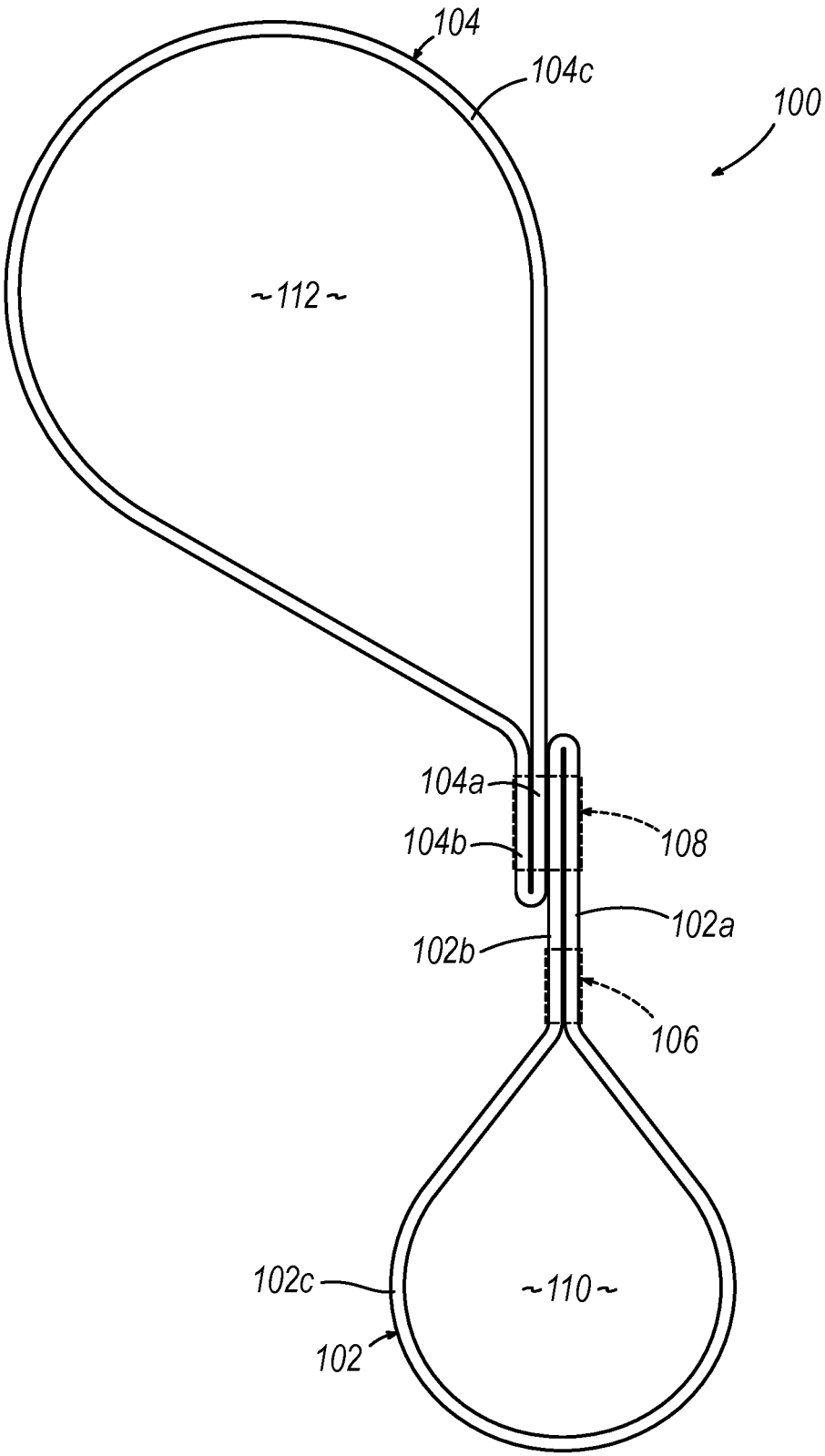
FIG. 2 depicts a top plan view of the sling of FIG. 1.
Figure 3:
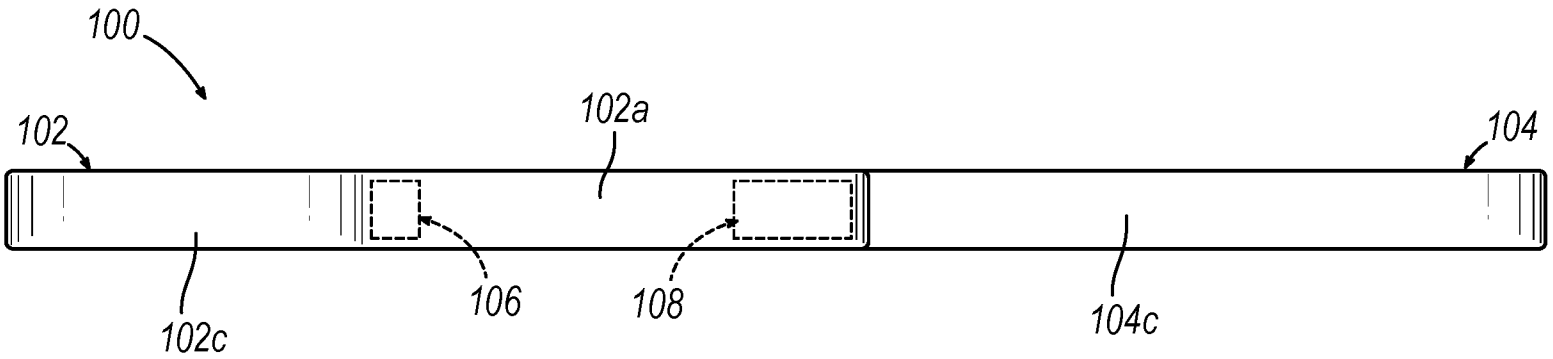
FIG. 3 depicts a side elevational view of the sling of FIG. 1.
Figure 4A:
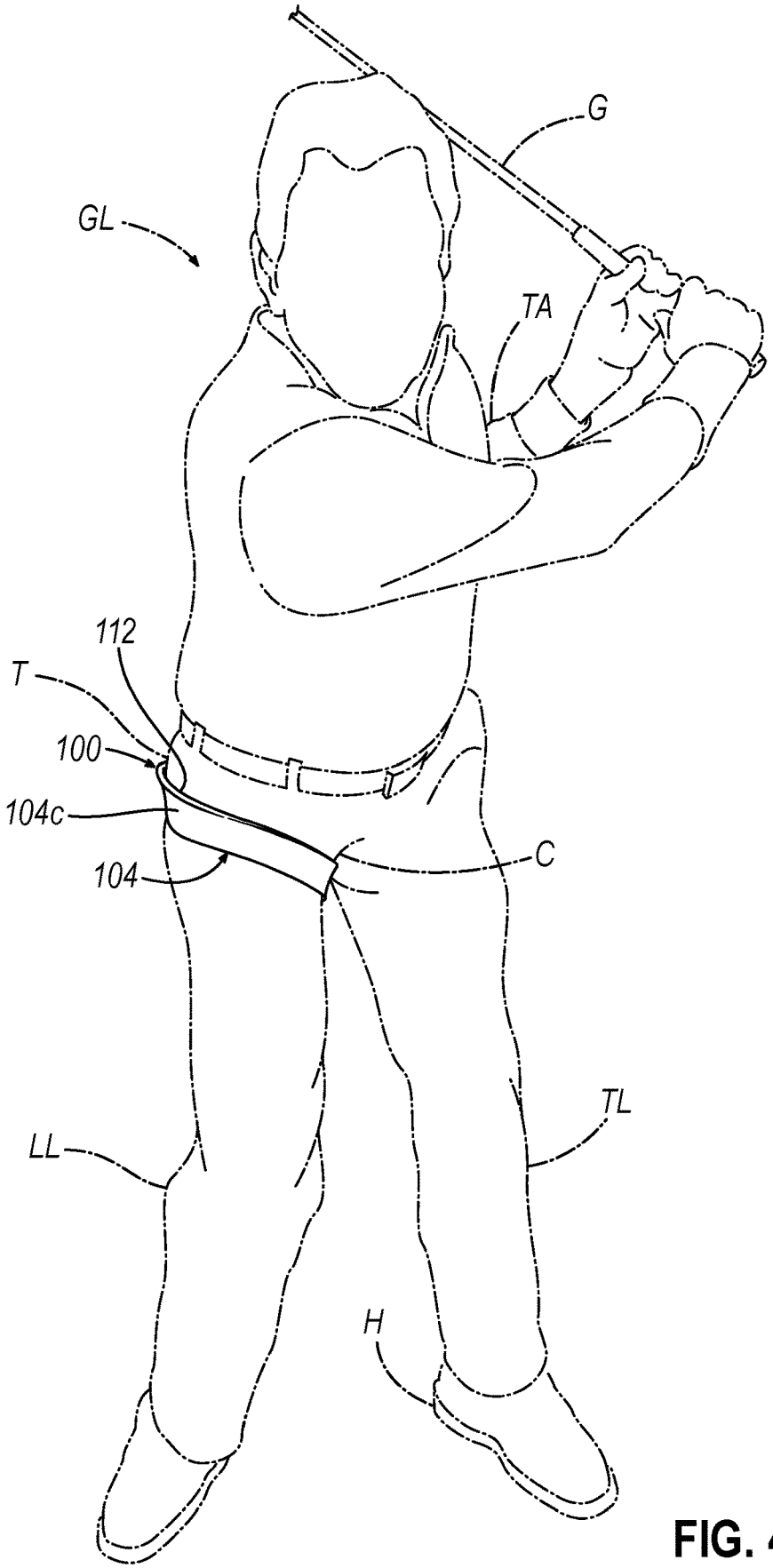
FIG. 4A depicts a front elevational view of a golfer wearing the sling of FIG. 1, the golfer being in a backswing position.
Figure 4B:
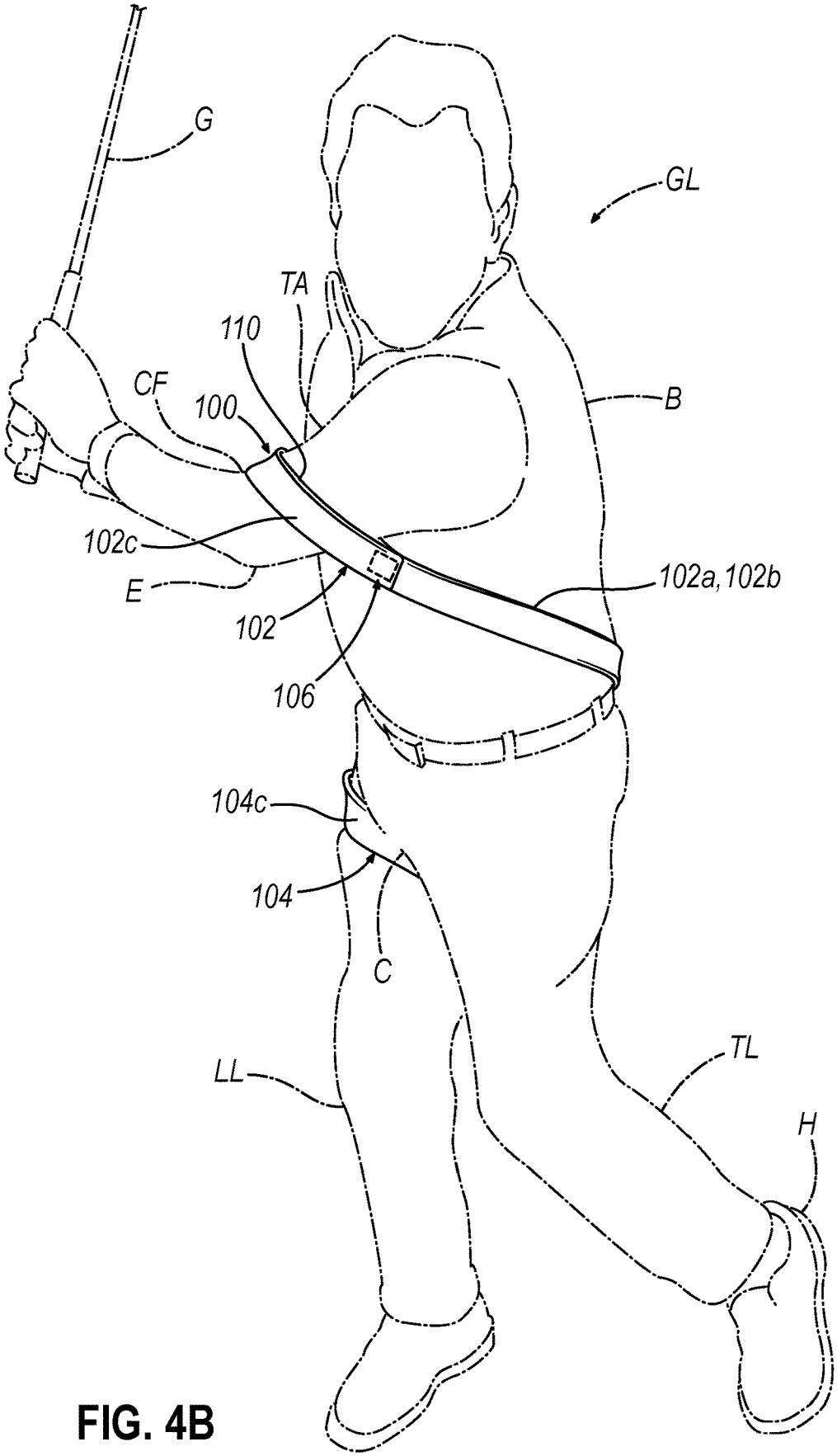
FIG. 4B depicts a front elevational view of the golfer of FIG. 4A wearing the sling of FIG. 1, the golfer being in a follow-through position.
Figure 5A:
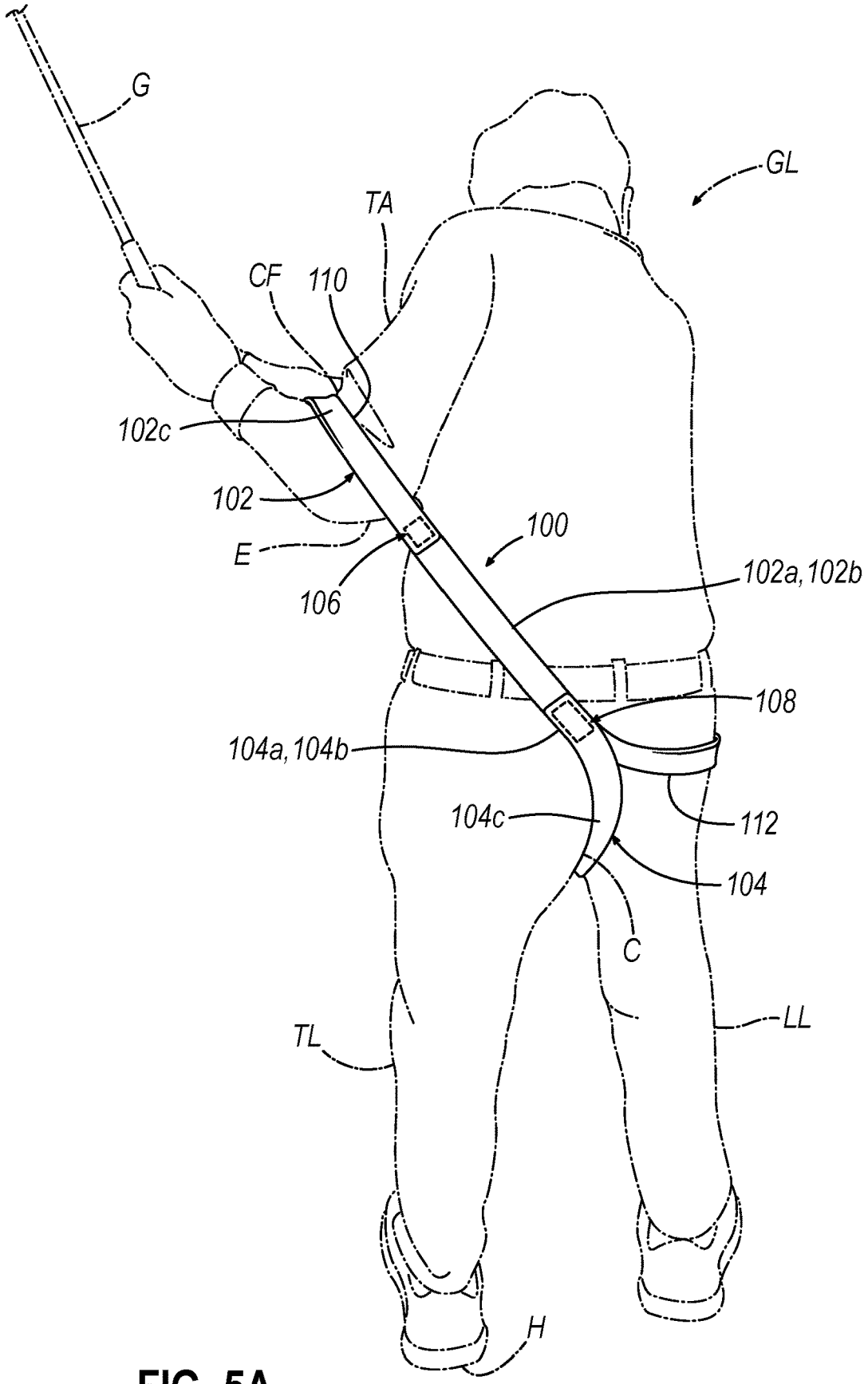
FIG. 5A depicts a rear elevational view of the golfer of FIG. 4A wearing the sling of FIG. 1, the golfer being in the backswing position.
Figure 5B:
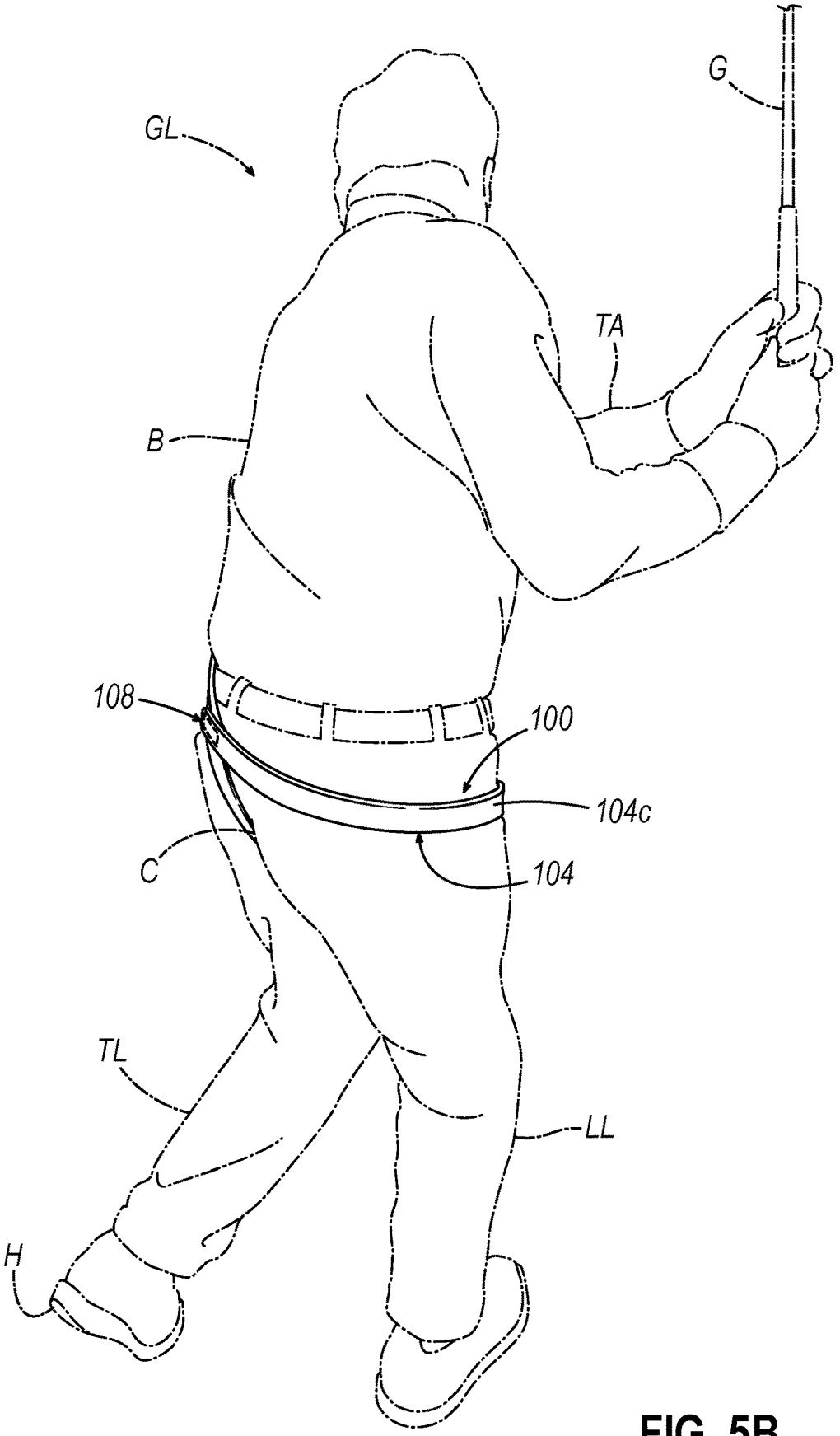
FIG. 5B depicts a rear elevational view of the golfer of FIG. 4A wearing the sling of FIG. 1, the golfer being in the follow-through position.

FIGS. 1-3 show an exemplary sling (100) that is generally configured to be worn by a golfer (GL, GR) to assist in improving the technique of his or her swing. As described in greater detail below, sling (100) may be configured to improve a golf swing of the golfer (GL, GR) by automatically raising the a heel (H) of a trailing leg (TL) of the golfer (GL, GR) as the golfer (GL, GR) transitions from a backswing position, through an impact position, to a follow-through position. Such raising of the golfer's trailing heel (H) may improve the ability of the golfer (GL, GR) to swing a golfclub (G) powerfully, accurately, and consistently. It will be appreciated that sling (100) may be worn by the golfer (GL, GR) while swinging a golfclub (G) during training practices and/or during competitive golf matches. Frequent wearing of sling (100) while swinging a golfclub (G) may improve the muscle memory of the golfer (GL, GR), such that the golfer (GL, GR) may eventually achieve the desired raising of the golfer's trailing heel (H) without continued wearing of sling (100). As described in greater detail below, sling (100) may be worn by a left-handed golfer (GL) (FIGS. 4A-5B) or a right-handed golfer (GR) (FIGS. 6A-6D).

Sling (100) of the present version comprises a first elastic band (102) and a second elastic band (104) coupled to each other. In the example shown, first elastic band (102) includes a pair of elongate segments (102*a*, 102*b*) coupled to each other along a portion of their respective lengths at a first coupling region or interface (106) to thereby form a looped segment (also referred to as an "arm loop") (102*c*) of first elastic band (102). Similarly, second elastic band (104) includes a pair of elongate segments (104*a*, 104*b*) coupled to each other along substantially their entire lengths at a second coupling region or interface (108) to thereby form a looped segment (also referred to as a "leg loop") (104*c*) of second elastic band (104). In the example shown, elongate segments (104*a*, 104*b*) of second elastic band (104) are also coupled to elongate segments (102*a*, 102*b*) of first elastic band (104) at second interface (108), to thereby couple first and second elastic bands (102, 104) to each other with looped segments (102*c*, 104*c*) generally opposed from each other. In some versions, looped segments (102*c*, 104*c*) may be arranged relative to each other to provide sling (100) with a generally figure eight-shaped profile. Each elastic band (102, 104) may have a perimeter ranging from about 19.2 in to about 28.8 in, such as about 24 in.

First and second interfaces (106, 108) may be defined by any suitable fastener(s) for either permanently or removably coupling the respective segments (102*a*, 102*b*, 104*a*, 104*b*) to each other, such as stitches, staples, rivets, snaps, clips, adhesive, welds, hook-and-loop fasteners, etc. In the example shown, first and second interfaces (106, 108) are spaced apart from each other such that elongate segments (102*a*, 102*b*) are not coupled to each other along the portion of their respective lengths extending between first and second interfaces (106, 108). Thus, elongate segments (102*a*, 102*b*) may be free to flex relative to each other between first and second interfaces (106, 108). In some versions, the lengths of the portions of elongate segments (102*a*, 102*b*) extending between first and second interfaces (106, 108) may range from about 4.8 in to about 7.2 in, such as about 6 in. In some other versions, first interface (106) may be omitted, such that first looped segment (102*c*) may be defined by second interface (108). It will be appreciated that first and/or second looped segments (102*c*, 104*c*) may be defined in any other suitable manner.

As shown, looped segment (102*c*) of first elastic band (102) defines a first aperture (110) that is sized and configured to receive a portion of a trailing arm (TA) of the golfer (GL, GR), such as an elbow (E) of the golfer's trailing arm (TA), while looped segment (104*c*) of second elastic band (104) defines a second aperture (112) that is sized and configured to receive a portion of a leading leg (LL) of the golfer (GL, GR), such as an upper thigh (T) of the golfer's leading leg (LL). In this regard, second aperture (112) may have a cross-sectional area and/or perimeter (e.g., circumference) that is substantially larger than that of first aperture (110). For example, first aperture (110) may have a first cross-sectional area ranging from about 6.4 $in^2$ to about 9.6 $in^2$, such as about 8 $in^2$; and/or second aperture (112) may have a second cross-sectional area ranging from about 25.6 $in^2$ to about 38.4 $in^2$, such as about 32 $in^2$. In addition or alternatively, first aperture (110) may have a first perimeter (e.g., circumference) ranging from about 8 in to about 12 in, such as about 10 in; and/or second aperture (112) may have a second perimeter (e.g., circumference) ranging from about 16 in to about 24 in, such as about 20 in. In some versions, the fastener(s) defining first and/or second interfaces (106, 108) may enable the lengths of one or both looped segments (102*c*, 104*c*) to be adjusted and thereby allow for the size of one or both apertures (110, 112) to be adjusted, such as for accommodating golfers (GL, GR) with differing body types and/or sizes.

Elastic bands (102, 104) of sling (100) may comprise any suitable natural and/or synthetic textile materials, such as fabric, cloth, rubber, latex, spandex, nylon, and/or polyester, for example. The material(s) of elastic bands (102, 104) may have sufficient elasticity to stretch when sling (100) is worn by the golfer as the golfer transitions between various positions, while maintaining a tendency to return to its original size and shape. For example, the material(s) of elastic bands (102, 104) may have the same elasticity of that of a typical elastic waistband for clothing (e.g., for skirts, trousers, shorts, swimsuits, and/or undergarments). In some versions, elastic bands (102, 104) may comprise the same material(s) as that of a typical elastic waistband. While elastic bands (102, 104) are shown and described as separate pieces that are coupled to each other to define sling (100), elastic bands (102, 104) may alternatively be integrally formed together with each other as a unitary piece. For example, sling (100) may be formed by a single elastic band as described below in connection with FIG. 7. In some versions, sling (100) may have a length ranging between about 24 inches and about 42 inches when in a relaxed (e.g., unstretched) state. In addition, or alternatively, sling (100) may have a width ranging between about 1 inch and about 2 inches.

As shown in FIGS. 4A-5B, in which sling (100) is shown being worn by a left-handed golfer (GL), first looped segment (102*c*) is configured to be positioned around the elbow (E) of the golfer's trailing arm (TA), such that the elbow (E) of the golfer's trailing arm (TA) is received within first aperture (110); second looped segment (104*c*) is configured to be positioned around the upper thigh (T) of the golfer's leading leg (LL), such that the upper thigh (T) of the golfer's leading leg (LL) is received within second aperture (112); and elongate segments (102*a*, 102*b*, 104*a*, 104*b*) are configured to be positioned along the golfer's back (B) to generally extend between the upper thigh (T) of the golfer's leading leg (LL) and the elbow (E) of the golfer's trailing arm (TA). When sling (100) is worn in this manner, a portion of first looped segment (102*c*) of first elastic band (102) may be seated at or near the cubital fossa (or "elbow pit") (CF) of the golfer's trailing arm (TA) with first interface (106) positioned at or near the tricep of the golfer's trailing arm (TA), second looped segment (104*c*) may be seated at or near the golfer's crotch (C) with second interface (108) positioned at or near a base of the golfer's spine (e.g., just below the golfer's hip), and elongate segments (102*a*, 102*b*, 104*a*, 104*b*) extend generally diagonally around the golfer's back (B) between interfaces (106, 108).

II. Exemplary Golf Swing Training Method

Having described exemplary features of sling (100) above, an exemplary method of swinging a golfclub (G) while wearing sling (1000 will now be described in connection with FIGS. 6A-6D. While the exemplary method is shown being performed by a right-handed golfer (GR), it will be appreciated that a similar method may be performed by a left-handed golfer (GL). The following method may thus assist both right-handed and left-handed golfers (GR, GL) in improving the technique of their golf swing and, more particularly, may enable golfers (GR, GL) to go through a golf swing with optimal propulsion of the ball with technically improved biomechanics.

One biomechanical benefit of using sling (100) in the following method is aiding the golfer (GR, GL) with improved posture through the torso and lower extremity. Using sling (100) in the following method may also allow the golfer's arms to rotate the golfer's shoulders properly, thereby turning the golfer's hips about 45° as to the golfer (GR, GL) transitions to a backswing position and allowing the golfer (GR, GL) to make a more powerful and accurate swing as the golfer's hips generate power as the golfer (GR, GL) transitions toward a follow-through position.

Using sling (100) in the following method may also assist the golfer (GR, GL) in keeping the golfer's leading foot on the ground and all the muscular weight results in the heel (H) of the golfer's trailing foot being off of the ground through the swing phase. This may ensure that the golfer (GR, GL)

has optimal balance through the golfer's swing, and thus allow greater power to be transferred from the golfer's body (GR, GL) to the golfclub (G) to the golf ball (not shown).

Figure 6A:
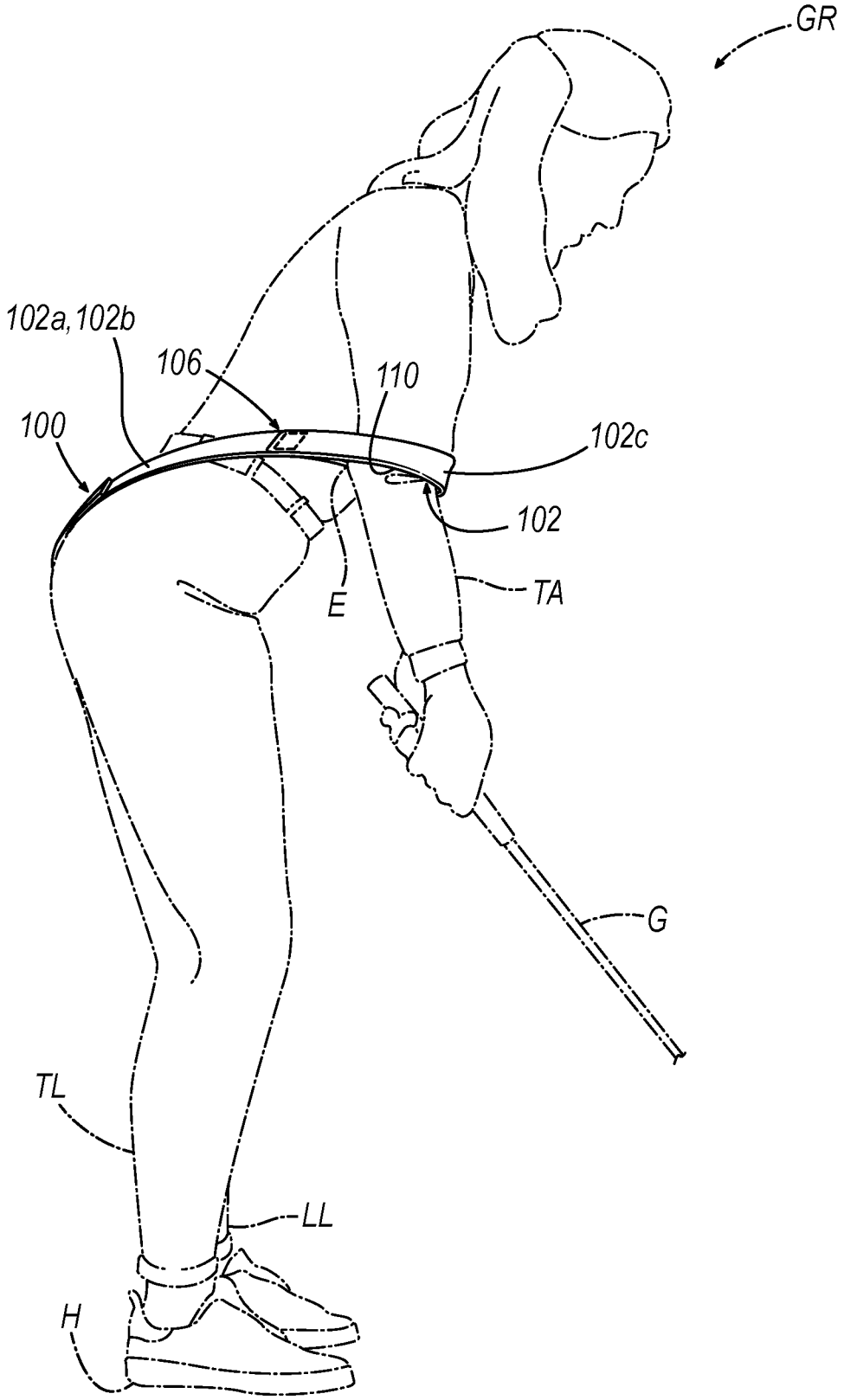
FIG. 6A depicts a side elevational view of another golfer wearing the sling of FIG. 1, the golfer being in an address position.

As shown in FIG. 6A, a right-handed golfer (GR) may initially be in an address position prior to swinging a golfclub (G), and may be wearing sling (100) in a manner similar to that described above. More particularly, first looped segment (102*c*) is positioned around the elbow (E) of the golfer's trailing arm (TA), such that the elbow (E) of the golfer's trailing arm (TA) is received within first aperture (110); second looped segment (104*c*) is positioned around the upper thigh (T) of the golfer's leading leg (LL), such that the upper thigh (T) of the golfer's leading leg (LL) is received within second aperture (112); and elongate segments (102*a*, 102*b*, 104*a*, 104*b*) are positioned along the golfer's back (B) to generally extend between the upper thigh (T) of the golfer's leading leg (LL) and the elbow (E) of the golfer's trailing arm (TA). A portion of first looped segment (102*c*) of first elastic band (102) may be seated at or near the cubital fossa of the golfer's trailing arm (TA) with first interface (106) positioned at or near the tricep of the golfer's trailing arm (TA), second looped segment (104*c*) may be seated at or near the golfer's crotch with second interface (108) positioned at or near a base of the golfer's spine, and elongate segments (102*a*, 102*b*, 104*a*, 104*b*) extend generally diagonally around the golfer's back (B) between interfaces (106, 108).

Figure 6B:
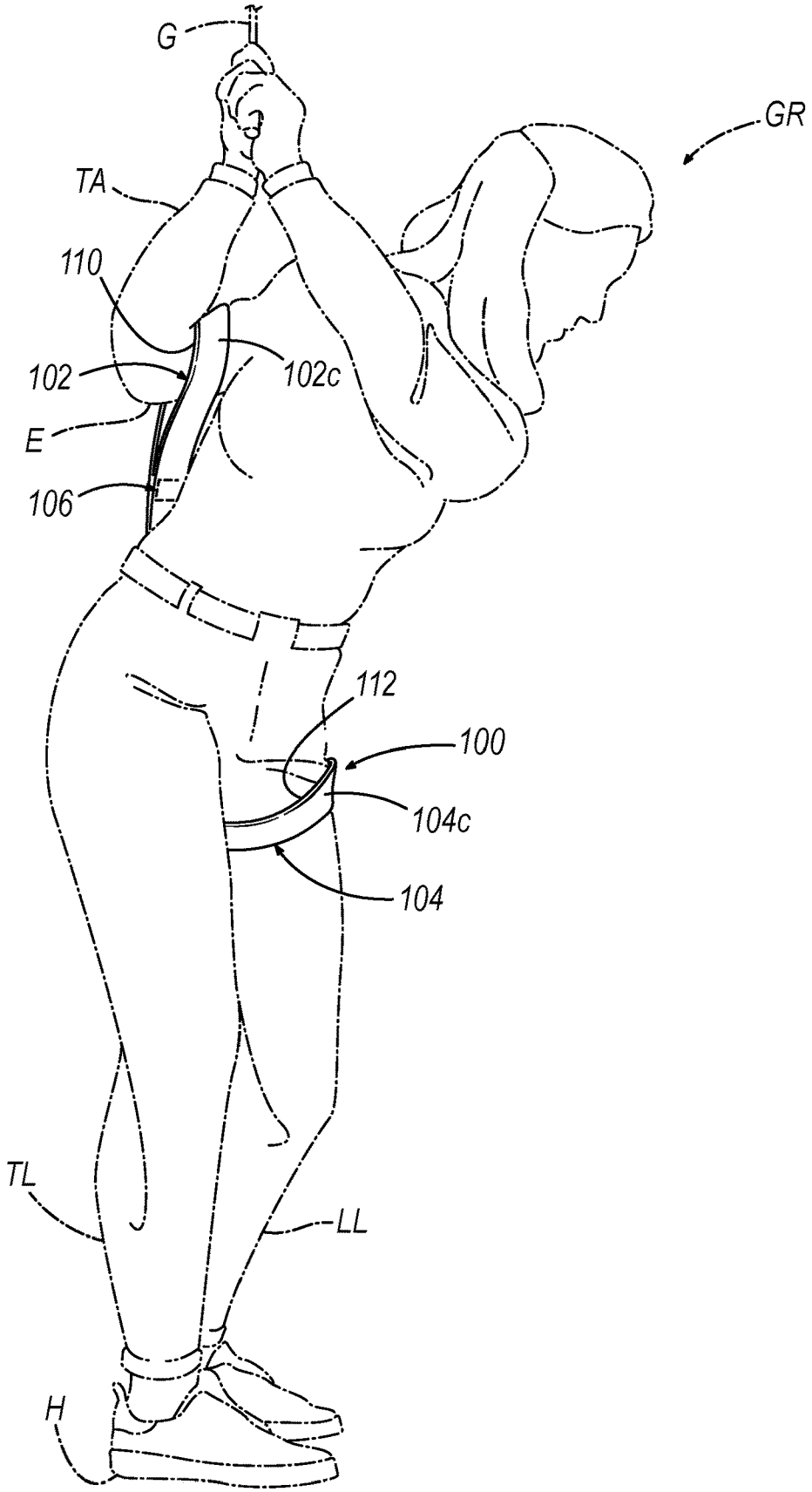
FIG. 6B depicts a side elevational view of the golfer of FIG. 6A wearing the sling of FIG. 1, the golfer being in a backswing position.

The golfer (GR) may then transition from the address position show in FIG. 6A to a backswing position, as shown in FIG. 6B, while continuously wearing sling (100) in the manner described above. In this regard, a portion of first looped segment (102*c*) of first elastic band (102) may remain seated at or near the cubital fossa of the golfer's trailing arm (TA) with first interface (106) positioned at or near the tricep of the golfer's trailing arm (TA), second looped segment (104*c*) may remain seated at or near the golfer's crotch with second interface (108) positioned at or near a base of the golfer's spine, and elongate segments (102*a*, 102*b*, 104*a*, 104*b*) remain extending generally diagonally around the golfer's back (B) between interfaces (106, 108). It will be appreciated that sling (100) may stretch or otherwise expand as the golfer (GR) transitions from the address position to the backswing position. In some instances, sling (100) may assist with ensuring that the golfer's arms move together in unison toward the backswing position and/or may assist with ensuring that a majority of the golfer's weight is carried by the golfer's trailing foot when in the backswing position.

Figure 6C:
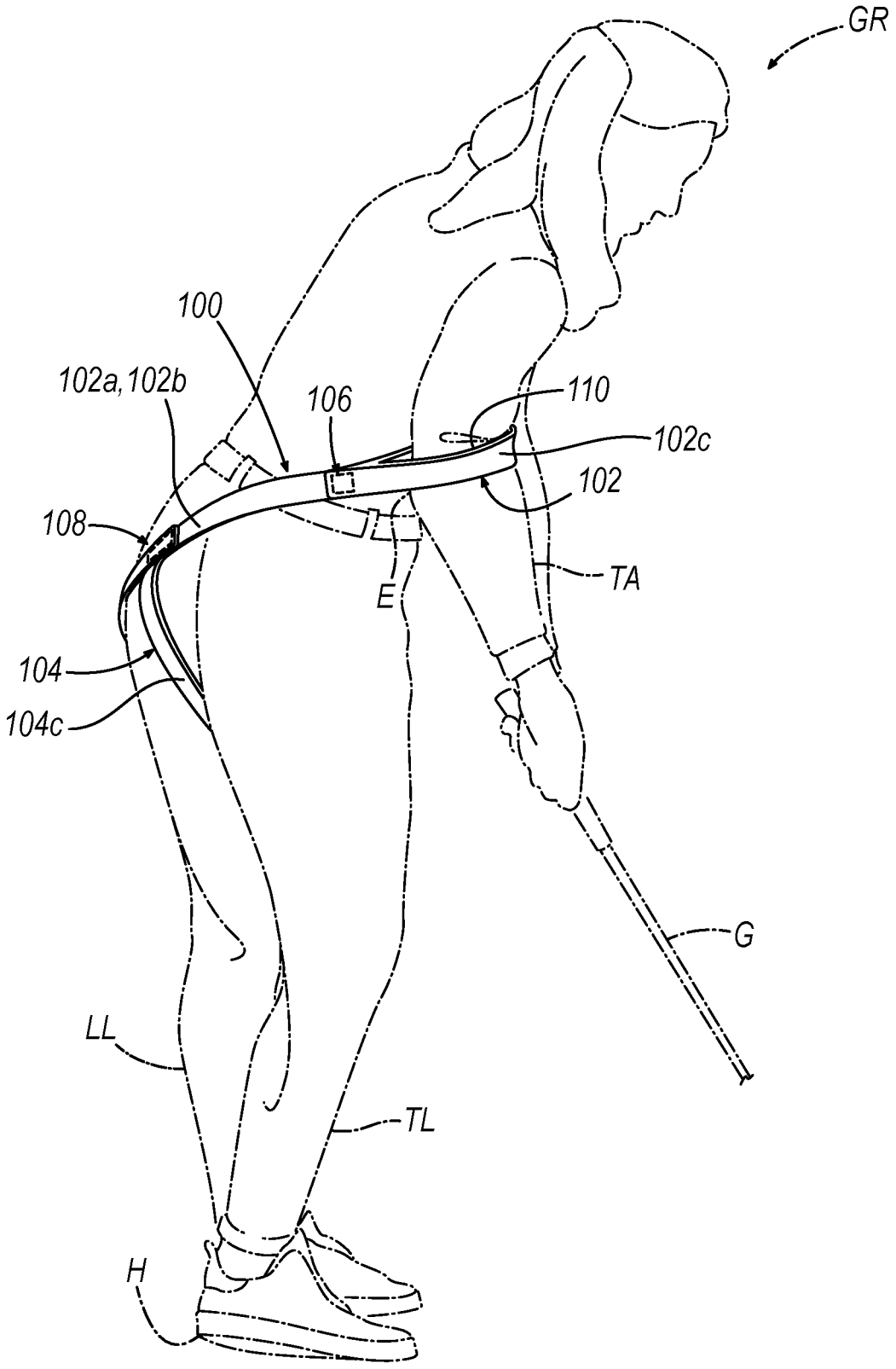
FIG. 6C depicts a side elevational view of the golfer of FIG. 6A wearing the sling of FIG. 1, the golfer being in an impact position.

The golfer (GR) may subsequently transition from the backswing position shown in FIG. 6B to an impact position (e, g., at which the golfer's golfclub (G) makes contact with the golf ball), as shown in FIG. 6C, while continuously wearing sling (100) in the manner described above. In this regard, a portion of first looped segment (102*c*) of first elastic band (102) may remain seated at or near the cubital fossa of the golfer's trailing arm (TA) with first interface (106) positioned at or near the tricep of the golfer's trailing arm (TA), second looped segment (104*c*) may remain seated at or near the golfer's crotch with second interface (108) positioned at or near a base of the golfer's spine, and elongate segments (102*a*, 102*b*, 104*a*, 104*b*) remain extending generally diagonally around the golfer's back (B) between interfaces (106, 108). It will be appreciated that sling (100) may begin to retract as the golfer (GR) transitions from the backswing position to the impact position. As shown in FIG. 6C, sling (100) may initiate raising of the heel (H) of the golfer's trailing leg (TL) during the transition from the backswing position to the impact position.

Figure 6D:
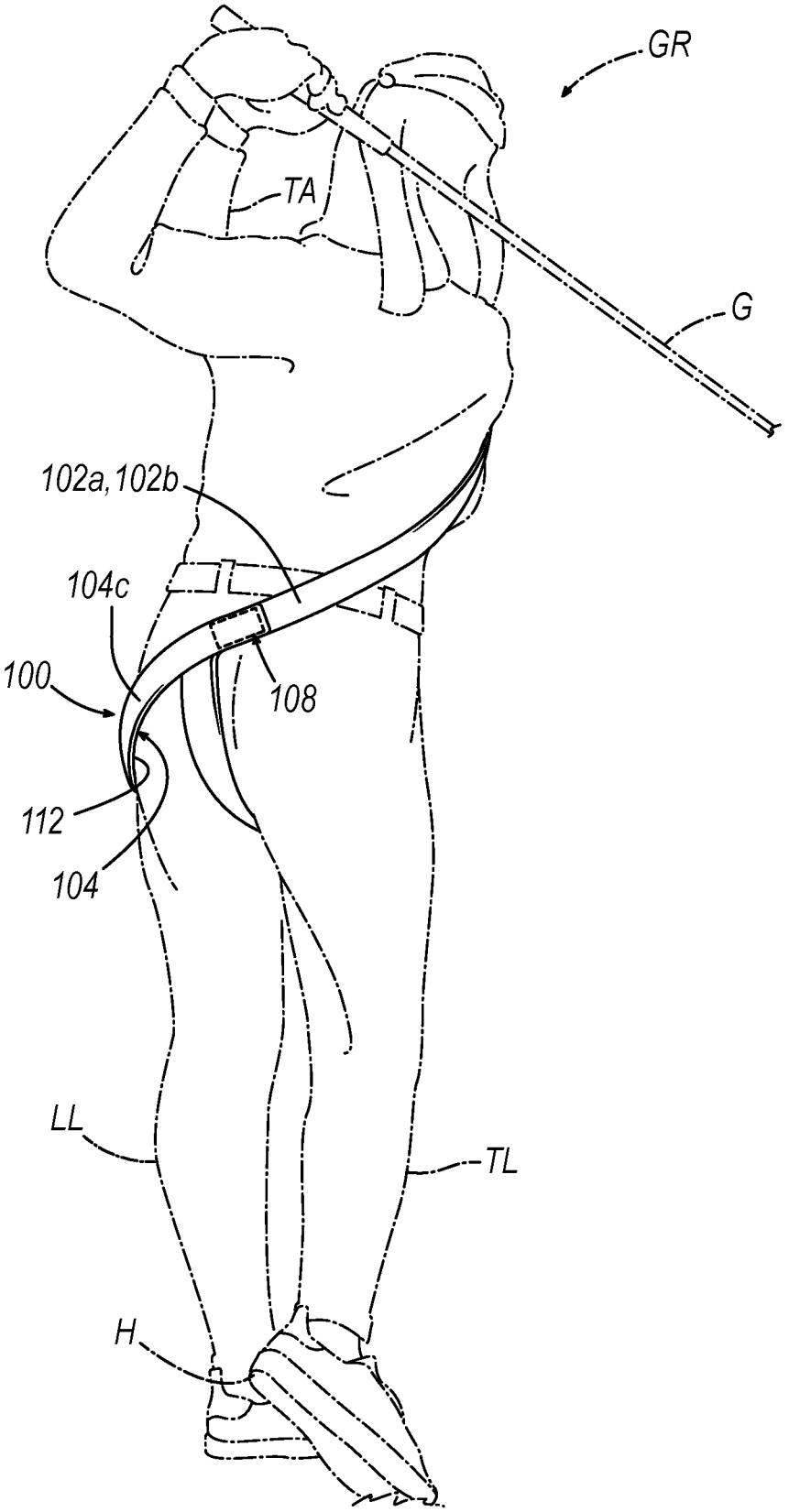
FIG. 6D depicts a side elevational view of the golfer of FIG. 6A wearing the sling of FIG. 1, the golfer being in a follow-through position.

Finally, the golfer (GR) may transition from the impact position shown in FIG. 6C to a follow-through position, as shown in FIG. 6D, while continuously wearing sling (100) in the manner described above. In this regard, a portion of first looped segment (102*c*) of first elastic band (102) may remain seated at or near the cubital fossa of the golfer's trailing arm (TA) with first interface (106) positioned at or near the tricep of the golfer's trailing arm (TA), second looped segment (104*c*) may remain seated at or near the golfer's crotch with second interface (108) positioned at or near a base of the golfer's spine, and elongate segments (102*a*, 102*b*, 104*a*, 104*b*) remain extending generally diagonally around the golfer's back (B) between interfaces (106, 108). It will be appreciated that sling (100) may continue to retract and/or may being to stretch again as the golfer (GR) transitions from the impact position to the follow-through position. As shown in FIG. 6D, sling (100) may further raise the heel (H) of the golfer's trailing leg (TL) during the transition from the impact position to the follow-through position, thereby ensuring that a majority of the golfer's weight is transferred to the golfer's front foot when in the follow-through position, and that the heel (H) of the golfer's trailing leg (TL) is off of the ground when in the impact and/or follow-through position(s).

III. Exemplary Alternative Golf Swing Training Apparatus

Figure 7:
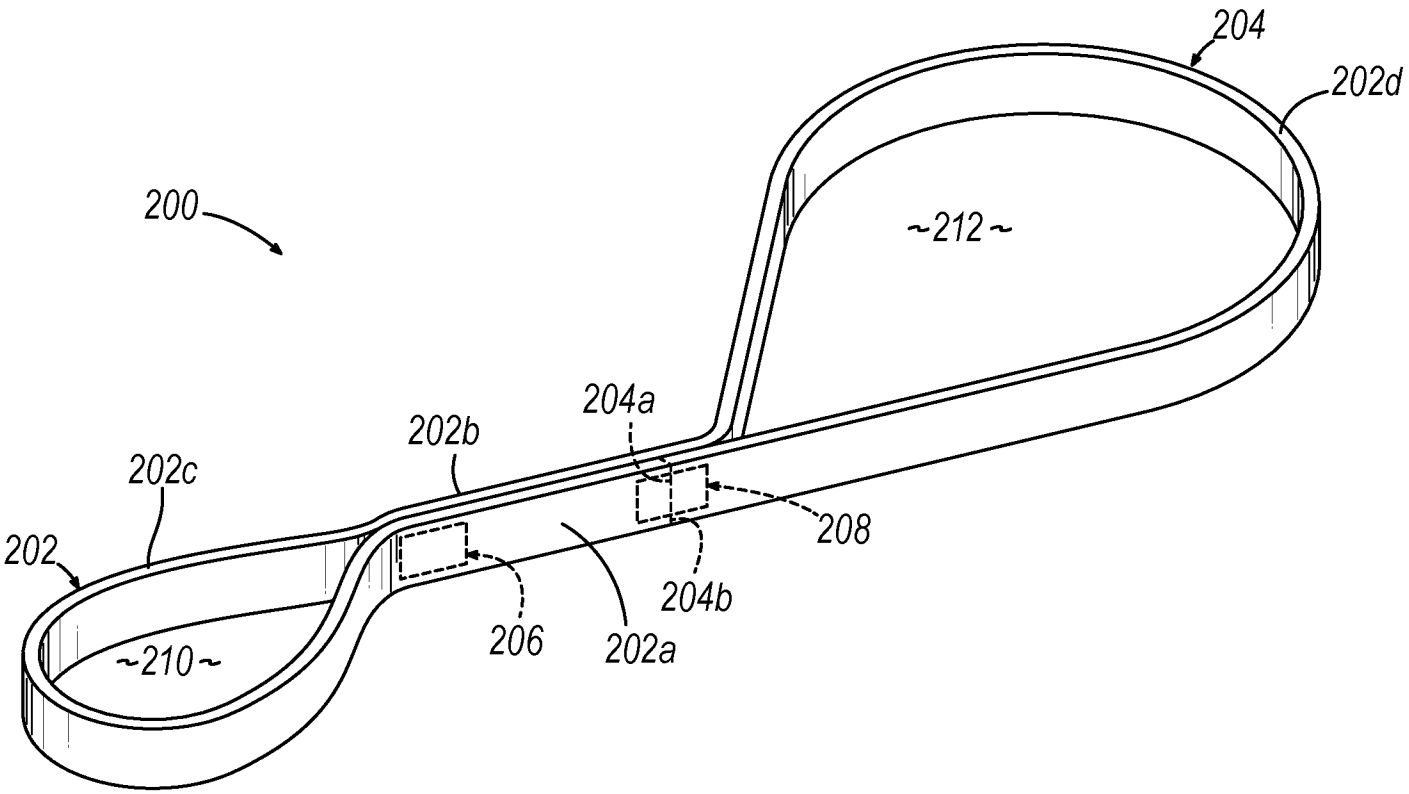
FIG. 7 depicts another example of a sling for improving a golfer's swinging technique, the sling including two looped segments formed by a single elastic band, the sling being in a relaxed (e.g., unstretched) state.

FIG. 7 shows another exemplary sling (200) that is generally configured to be worn by a golfer (GL, GR) to assist in improving the technique of his or her swing. Sling (200) is similar to sling (100) described above, except as otherwise described below. In this regard, sling (200) of the present version comprises a single elastic band (202). In the example shown, elastic band (202) is defined by an elongate elastic strip (204) that is coupled to itself at both ends (204*a*, 204*b*). Elastic band (202) includes a pair of elongate segments (202*a*, 202*b*) coupled to each other along a first portion of their respective lengths at a first coupling region or interface (206) to thereby form a first looped segment (also referred to as an "arm loop") (202*c*) of elastic band (202). Elongate segments (202*a*, 202*b*) are also coupled to each other along a second portion of their respective lengths at a second coupling region or interface (208) to thereby form a second looped segment (also referred to as a "leg loop") (202*d*) of elastic band (202). In the example shown, ends (204*a*, 204*b*) of elastic strip (204) are also coupled to each other at second interface (208), to thereby form elastic band (202) with looped segments (202*c*, 202*d*) generally opposed from each other. In some versions, looped segments (202*c*, 202*d*) may be arranged relative to each other to provide sling (200) with a generally figure eight-shaped profile. Elastic strip (204) may have a length ranging from about 38.4 in to about 57.6 in, such as about 48 in.

As shown, first looped segment (202*c*) of elastic band (202) defines a first aperture (210) that is sized and configured to receive a portion of a trailing arm (TA) of the golfer (GL, GR), such as an elbow (E) of the golfer's trailing arm (TA), while second looped segment (202*d*) of elastic band (202) defines a second aperture (212) that is sized and configured to receive a portion of a leading leg (LL) of the golfer (GL, GR), such as an upper thigh (T) of the golfer's leading leg (LL). It will be appreciated that sling (200) may be worn and used just like sling (100) described above in connection with FIGS. 4A-6D.

IV. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A golf swing training apparatus comprising: (a) an elastic sling configured to transition between an unstretched state and at least one stretched state, the elastic sling comprising: (i) an arm loop, and (ii) a leg loop coupled to the arm loop; (b) a first aperture defined by the arm loop, wherein the first aperture is sized and configured to receive a trailing arm elbow of a golfer such that a portion of the arm loop is seated at or near a trailing arm cubital fossa of the golfer; and (c) a second aperture defined by the leg loop, wherein the second aperture is sized and configured to receive a leading leg upper thigh of the golfer such that a portion of the leg loop is seated at or near a crotch of the golfer when the portion of the arm loop is seated at or near the trailing arm cubital fossa of the golfer.

Example 2

The golf swing training apparatus of Example 1, wherein the elastic sling further comprises at least one elongate segment extending between the arm loop and the leg loop.

Example 3

The golf swing training apparatus of Example 2, wherein at least one of the arm loop, the leg loop, or the at least one elongate segment is elastic.

Example 4

The golf swing training apparatus of Example 3, wherein at least one of the arm loop, the leg loop, or the at least one elongate segment comprises at least one of fabric, cloth, rubber, spandex, nylon, and/or polyester.

Example 5

The golf swing training apparatus of any of Examples 1 through 4, wherein the second aperture is larger than the first aperture.

Example 6

The golf swing training apparatus of any of Examples 1 through 5, wherein the elastic sling is configured to stretch when worn by the golfer in response to the golfer transitioning from an address position toward a backswing position.

Example 7

The golf swing training apparatus of Example 6, wherein the elastic sling is configured to retract when worn by the golfer in response to the golfer transitioning from the backswing position toward an impact position.

Example 8

The golf swing training apparatus of Example 7, wherein the elastic sling is configured to stretch when worn by the golfer in response to the golfer transitioning from the impact position toward a follow-through position.

Example 9

The golf swing training apparatus of Example 8, wherein the elastic sling is configured to promote lifting of a trailing leg heel of the golfer when worn by the golfer in response to at least one of the golfer transitioning from the backswing position toward the impact position or the golfer transitioning from the impact position toward the follow-through position.

Example 10

The golf swing training apparatus of any of Examples 1 through 9, wherein at least one of the arm loop or the leg loop is adjustable.

Example 11

A method of improving a golfer's golfclub swing, the method comprising: (a) wearing an elastic sling having an arm loop and a leg loop coupled to each other, such that a trailing arm elbow of the golfer is received within a first aperture defined by the arm loop with a portion of the arm loop seated at or near a trailing arm cubital fossa of the golfer, and such that a leading leg upper thigh of the golfer is received within a second aperture defined by the leg loop with a portion of the leg loop seated at or near a crotch of the golfer; (b) assuming an address position while wearing the elastic sling; (c) transitioning from the address position toward a backswing position while wearing the elastic sling; (d) transitioning from the backswing position toward an impact position while wearing the elastic sling; and (e) transitioning from the impact position toward a follow-though position while wearing the elastic sling.

Example 12

The method of Example 11, further comprising gripping a golfclub during the acts of assuming the address position, transitioning toward the backswing position, transitioning toward the impact position, and transitioning toward the follow-through position.

Example 13

The method of any of Examples 11 through 12, wherein the elastic sling stretches during the act of transitioning toward the backswing position.

Example 14

The method of Example 13, wherein the elastic sling retracts during the act of transitioning toward the impact position.

Example 15

The method of Example 14, wherein the elastic sling stretches during the act of transitioning toward the follow-through position.

Example 16

The method of any of Examples 11 through 15, wherein the elastic sling promotes lifting of a trailing leg heel of the golfer during the act of transitioning toward the impact position.

Example 17

The method of any of Examples 11 through 16, wherein the elastic sling promotes lifting of a trailing leg heel of the golfer during the act of transitioning toward the follow-through position.

Example 18

A method of improving a golfer's golfclub swing, the method comprising: (a) wearing an elastic sling having an arm loop and a leg loop coupled to each other, such that a trailing arm elbow of the golfer is received within a first aperture defined by the arm loop with a portion of the arm loop seated at or near a trailing arm cubital fossa of the golfer, and such that a leading leg upper thigh of the golfer is received within a second aperture defined by the leg loop with a portion of the leg loop seated at or near a crotch of the golfer; (b) gripping a golfclub while wearing the elastic sling; and (c) swinging the golfclub while wearing the elastic sling.

Example 19

The method of Example 18, wherein the elastic sling stretches and retracts during the act of swinging the golfclub.

Example 20

The method of any of Examples 18 through 19, wherein the elastic sling causes a trailing leg heel of the golfer to rise during the act of swinging the golfclub.

V. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A golf swing training apparatus comprising:

(a) an elastic sling configured to transition between an unstretched state and at least one stretched state, the elastic sling comprising a single elastic band defined by an elongate elastic strip, the elongate elastic strip having first and second ends coupled to each other, the single elastic band comprising a pair of elastic elongate segments coupled to each other at first and second interfaces to thereby form:

(i) an elastic arm loop, and (ii) an elastic leg loop coupled to the arm loop and arranged relative to the arm loop such that the elastic sling has a generally figure eight-shaped profile;

(b) a first aperture defined by the arm loop, wherein the first aperture is sized and configured to receive a trailing arm elbow of a golfer such that a portion of the arm loop is seated at a trailing arm cubital fossa of the golfer; and (c) a second aperture defined by the leg loop, wherein the second aperture is sized and configured to receive a leading leg upper thigh of the golfer such that a portion of the leg loop is seated at a crotch of the golfer when the portion of the arm loop is seated at the trailing arm cubital fossa of the golfer, wherein the pair of elongate segments extend between the arm loop and the leg loop, and are sized and configured to extend diagonally around a back of the golfer when worn by the golfer, wherein the elastic sling is configured to stretch when worn by the golfer in response to the golfer transitioning from an address position toward a backswing position, wherein the elastic sling is configured to retract when worn by the golfer in response to the golfer transitioning from the backswing position toward an impact position, wherein the elastic sling is configured to stretch when worn by the golfer in response to the golfer transitioning from the impact position toward a follow-through position, wherein the elastic sling is configured to promote lifting of a trailing leg heel of the golfer when worn by the golfer in response to at least one of the golfer transitioning from the backswing position toward the impact position or the golfer transitioning from the impact position toward the follow-through position.

2. The golf swing training apparatus of claim 1, wherein the single elastic band comprises at least one of fabric, cloth, rubber, spandex, nylon, and/or polyester.

3. The golf swing training apparatus of claim 1, wherein the second aperture is larger than the first aperture.

4. The golf swing training apparatus of claim 1, wherein at least one of the arm loop or the leg loop is adjustable.

5. The golf swing training apparatus of claim 1, wherein the elongate elastic strip has a length ranging from about 38.4 in to about 57.6 in.

6. The golf swing training apparatus of claim 1, wherein the first and second ends of the elongate elastic strip are coupled to each other at one of the first or second interfaces.

7. The golf swing training apparatus of claim 1, wherein at least one of the first or second interfaces is defined by stitches.

8. The golf swing training apparatus of claim 1, wherein the first and second interfaces are spaced apart from each other.

9. The golf swing training apparatus of claim 1, the elastic sling consisting of the single elastic band.

10. A method of improving a golfer's golfclub swing, the method comprising:

(a) wearing an elastic sling having an arm loop and a leg loop coupled to each other, such that a trailing arm elbow of the golfer is received within a first aperture defined by the arm loop with a portion of the arm loop seated at a trailing arm cubital fossa of the golfer, and such that a leading leg upper thigh of the golfer is received within a second aperture defined by the leg loop with a portion of the leg loop seated at a crotch of the golfer, the elastic sling comprising a single elastic band that forms both the arm loop and the leg loop;

(b) assuming an address position while wearing the elastic sling;

(c) transitioning from the address position toward a backswing position while wearing the elastic sling;

(d) transitioning from the backswing position toward an impact position while wearing the elastic sling; and (e) transitioning from the impact position toward a follow-though position while wearing the elastic sling.

11. The method of claim 10, further comprising gripping a golfclub during the acts of assuming the address position, transitioning toward the backswing position, transitioning toward the impact position, and transitioning toward the follow-through position.

12. The method of claim 10, wherein the elastic sling stretches during the act of transitioning toward the backswing position.

13. The method of claim 12, wherein the elastic sling retracts during the act of transitioning toward the impact position.

14. The method of claim 13, wherein the elastic sling stretches during the act of transitioning toward the follow-through position.

15. The method of claim 10, wherein the elastic sling promotes lifting of a trailing leg heel of the golfer during the act of transitioning toward the impact position.

16. The method of claim 10, wherein the elastic sling promotes lifting of a trailing leg heel of the golfer during the act of transitioning toward the follow-through position.

17. The method of claim 10, wherein the elastic sling has an elongate segment extending between the arm loop and the leg loop, wherein wearing the elastic sling includes wearing the elastic sling such that the elongate segment extends diagonally around a back of the golfer.

18. A method of improving a golfer's golfclub swing, the method comprising:

(a) wearing an elastic sling having an arm loop and a leg loop coupled to each other, such that a trailing arm elbow of the golfer is received within a first aperture defined by the arm loop with a portion of the arm loop seated at a trailing arm cubital fossa of the golfer, and such that a leading leg upper thigh of the golfer is received within a second aperture defined by the leg loop with a portion of the leg loop seated at a crotch of the golfer, the elastic sling comprising a single elastic band that forms both the arm loop and the leg loop;

(b) gripping a golfclub while wearing the elastic sling; and (c) swinging the golfclub while wearing the elastic sling.

19. The method of claim 18, wherein the elastic sling stretches and retracts during the act of swinging the golfclub.

20. The method of claim 18, wherein the elastic sling causes a trailing leg heel of the golfer to rise during the act of swinging the golfclub.

* * * * *